US005689838A

United States Patent [19]

MacKenzie

[11] Patent Number: 5,689,838

[45] Date of Patent: Nov. 25, 1997

[54] LOWERING APPARATUS FOR TOILET SEAT AND TOILET SEAT COVERS

[76] Inventor: Andrew R. MacKenzie, 23295 Park Basilico, Calabasas, Calif. 91302

[21] Appl. No.: 675,438

[22] Filed: Jun. 28, 1996

[51] Int. Cl.[6] ..... A47K 13/10

[52] U.S. Cl. ..... 4/246.1; 4/248

[58] Field of Search ..... 4/246.1, 248, 250

[56] References Cited

U.S. PATENT DOCUMENTS

| | | | |
|---|---|---|---|
| 2,011,404 | 8/1935 | Giliasso | 4/251 |
| 4,477,933 | 10/1984 | Leckie | 4/253 |
| 4,839,928 | 6/1989 | Probasco | 4/246.1 |
| 5,058,216 | 10/1991 | Trayer et al. | 4/251 |
| 5,060,718 | 10/1991 | Jaskiewicz | 4/248 |
| 5,222,260 | 6/1993 | Piper | 4/246 |
| 5,339,468 | 8/1994 | Lin | 4/246 |
| 5,430,897 | 7/1995 | Lavender | 4/246.1 |
| 5,488,744 | 2/1996 | Paananen | 4/246.2 |
| 5,504,947 | 4/1996 | Robello et al. | 4/246.1 |
| 5,592,700 | 1/1997 | Genesse | 4/246.1 |

*Primary Examiner*—David J. Walczak
*Attorney, Agent, or Firm*—Jack C. Munro

[57] ABSTRACT

A lowering apparatus to be mounted on the water tank of a conventional toilet with the lowering apparatus including a pair of pivoting levers. One of the levers is to be contacted by the flush lever of the toilet and when so contacted causes a second lever to be pivoted which pushes against the toilet seat cover of the toilet causing the toilet seat cover to be moved from an upper position to a lower position.

2 Claims, 1 Drawing Sheet

LOWERING APPARATUS FOR TOILET SEAT AND TOILET SEAT COVERS

BACKGROUND OF THE INVENTION

1) Field of the Invention

The present invention relates to a device for lowering a toilet seat and toilet seat cover of a conventional toilet which is activated by the normal flushing action of the toilet.

2) Description of the Prior Art

All bathrooms include what is referred to as a conventional toilet. This conventional toilet is utilized by both males and females. A conventional toilet includes a toilet seat which is mounted on the toilet bowl. The female uses the toilet seat when it is placed against the toilet bowl by sitting on the toilet seat. One of the usages of the male is with the toilet seat in an upward position spaced from the toilet bowl. When the toilet seat is in the lower position against the toilet bowl, there is usually included a toilet seat cover which is to be movable onto the toilet seat covering the opening within the toilet seat. Desirable etiquette is for the toilet seat and toilet seat cover to be located in the position covering the toilet bowl when the toilet is not in use.

A substantial number of males are not accustomed to moving the toilet seat and the toilet seat cover to the lower position after usage. There is no doubt that the toilet has a better overall appearance when the toilet seat is in the lower position and the toilet seat cover is in the lower position. Also, there are other advantages to having the toilet seat and the toilet seat cover in the lower position. One of these advantages is that if there happens to be any dust moving within the room, the toilet bowl would be protected from the accumulation of dust. Also, for safety reasons it is desirable to have the toilet bowl covered by the seat cover to prevent small children, pets and household articles from falling into the toilet. Even adults may be subjected to inconvenience and even possible injury when attempting to use the toilet thinking that the toilet seat is in the down position when it is not.

It is desirable to utilize some form of device in conjunction with the toilet for automatically lowering of the toilet seat and the toilet seat cover. Previously, there have been many such devices that have been patented. These devices all seem to be relatively complex. Because of their complexity, the cost of manufacture has been significant which has resulted in non-usage of these types of devices.

SUMMARY OF THE INVENTION

One of the primary objectives of the present invention is to construct an automatic toilet seat and toilet seat cover lowering apparatus which is non-complex in construction and therefore can be manufactured at a reasonable cost and sold to the ultimate consumer at a reasonable cost.

It is another objective of the present invention to provide a toilet seat and toilet seat cover lowering apparatus which is automatically activated in response to the flushing of the toilet.

Another objective of the present invention is to provide a toilet seat and toilet seat cover lowering apparatus which can be quickly installed by persons having limited or no mechanical training or experience.

Another objective of the present invention is to provide a toilet seat and toilet seat cover lowering apparatus which can be installed without the use of tools.

Another objective of the present invention is to provide a toilet seat and toilet seat cover lowering apparatus which can be installed without modifying the toilet in any way.

Another objective of the present invention is to provide a toilet seat and toilet seat cover lowering apparatus which can be manufactured and placed in a small package thereby facilitating ease and economy of shipping and storage.

Another objective of the present invention is to provide a toilet seat and toilet seat cover lowering apparatus which does not impede the manual raising of the toilet seat and toilet seat cover to its stable upright position.

The apparatus of the present invention is directed to the utilizing of an elongated main body section which is to be attached by adhesive to the outer surface of the water tank of a conventional toilet. The elongated main body section is to be at a precise location so that a first lever, which is pivotally mounted on the aft end of the elongated main body section, is contactable by the flush lever of the toilet. The first lever is attached to a link which connects with a second lever which is pivotally mounted at the fore end of the elongated main body section. Movement of the flush lever of the toilet will result in the second lever pivoting in an outward direction contacting the toilet seat cover causing such to be moved from the upper (vertical) position to a lower (horizontal) position. Movement of the toilet seat cover will automatically carry with it the toilet seat if the toilet seat is also in the upper (vertical) position. Both the toilet seat and the toilet seat cover are to include at least one impact damper that will prevent the toilet seat and toilet seat cover from slamming hard into the toilet bowl when being moved from the upper position to the lower position.

DETAILED DESCRIPTION OF THE PREFERRED EMBODIMENT

Figure 1:
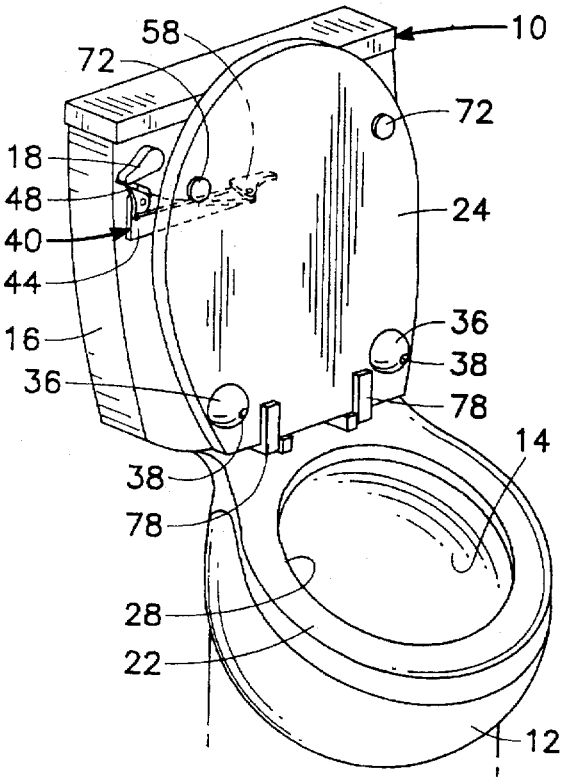
FIG. 1 is a front isometric view of a conventional toilet showing the lowering apparatus being mounted on the water tank of the toilet with the seat cover being located in the upper position.
Figure 4:
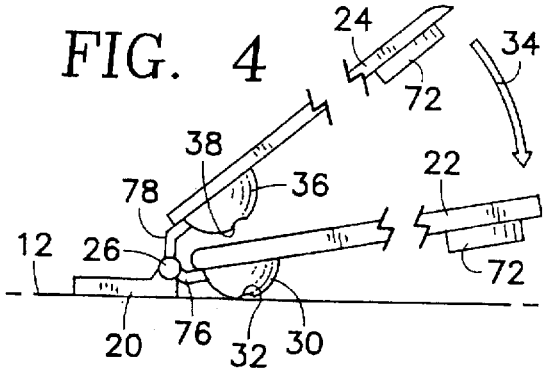
FIG. 4 is a side view depicting movement of the toilet seat cover and the toilet seat to the lower position.

Referring particularly to the drawing there is shown a conventional toilet 10 which is constructed generally of a toilet bowl 12 which has an internal chamber 14 and a water tank 16. The water tank 16 is fixedly mounted on a portion of the bowl 12. Mounted on the exterior sidewall of the water tank 16 is a flush lever 18. Movement of the flush lever 18 from the position shown in FIG. 1 to a downwardly depending position, which is depicted in dotted lines in FIG. 3, will result in operation of the toilet 10 with water being caused to flow from the water tank 16 into the internal chamber 14 to effect discharging of the contents of the internal chamber 14 into a sewage line (not shown).

Mounted on the toilet bowl 12 by means of a mounting flange 20 is a toilet seat 22 and a toilet seat cover 24. Both the toilet seat 22 and the toilet seat cover 24 are connected to hinge 26 which is mounted on the mounting flange 20. The toilet seat 22 is mounted by an arm assembly 76 to the hinge 26 and the mounting flange 20. In a similar manner an arm assembly 78, comprising a pair of separate arms, is utilized to mount the toilet seat cover 24 to the hinge 26 and the mounting flange 20. The toilet seat cover 24 is solid but the toilet seat 22 has an internal opening 28 which is to connect with the internal chamber 14 of the bowl 12.

Mounted on the undersurface of the toilet seat 22 is an impact device 30. The impact device 30 can comprise a hemispherical-shaped object which is basically hollow and is readily deformable. As the impact device 30 deforms, air is released from inside the impact device 30 through a hole 32 formed within the impact device 30. One or two in number of the impact device 30 may be mounted on the toilet seat 22. When the toilet seat 22 falls freely from an upper position to a lower position in the direction of arrow 34, the impact device 30 will compress and thereby slow the movement of the toilet seat 22 so that the toilet seat 22 does not slam down onto the toilet bowl 12.

In a similar manner, two in number of impact device 36 are to be mounted on the underside of the toilet seat cover 24. However, it is considered to be within the scope of this invention that only a single such impact device 36 may be used. Again the impact device 36 includes a hole 38. The impact device 36 is to operate as a damper and is identical to the impact device 30. The impact device 36 will slow the downward motion of the toilet seat cover 24 so that it does not slam onto the toilet seat 22.

Figure 2:
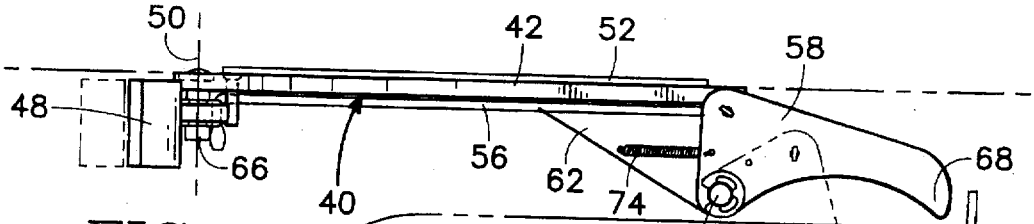
FIG. 2 is a top plan view of the lowering apparatus of the present invention showing movement of the lowering apparatus in order to cause the seat cover to be moved to the lower position.
Figure 3:
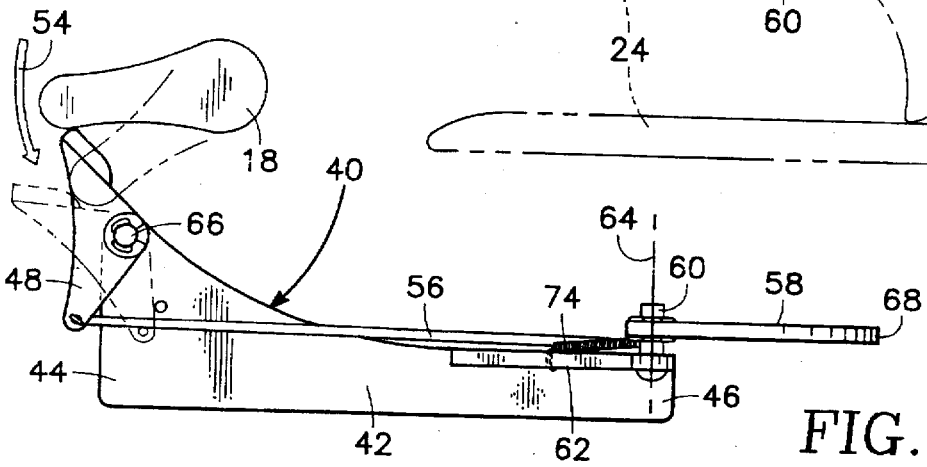
FIG. 3 is a front view of the lowering apparatus of the present invention.

The lowering apparatus 40 constitutes a thin sheet material main body section 42. The main body section 42 has an aft end 44 and a fore end 46. A first lever 48 is pivotally mounted about a pivot axis 50 to the aft end 44 of the main body section 42. Pivot axis 50 comprises the longitudinal center axis of pivot pin 66. The main body section 42 has an adhesive strip 52 attached to the backside of the main body section 42. The adhesive strip 52 is to be used to securely mount the main body section 42 onto the exterior surface of the water tank 16. This mounting is to be such that the flush lever 18, when moved in the downward direction as depicted by arrow 54, will come in contact with the first lever 48. This contact will result in the first lever 48 pivoting to the dotted line position as shown in FIGS. 2 and 3 of the drawings. The lower end of the first lever 48 is pivotally connected to a link 56. The link 56 constitutes no more than a thin rod. This thin rod is pivotally attached to a second lever 58. The second lever 58 is pivotally connected by a pivot pin 60 to a horizontal shelf 62 which comprises an integral extension on the main body section 42. The second lever 58 is pivotable about a second pivot axis 64 which comprises a longitudinal center axis of the pivot pin 60. It is to be noted that the pivot axis 64 is located in a perpendicular arrangement when compared to the pivot axis 50 with axes 50 and 64 being spaced apart.

Pivot axis 64 is also located vertical and if extended would intersect the toilet bowl 12.

Figure 5:
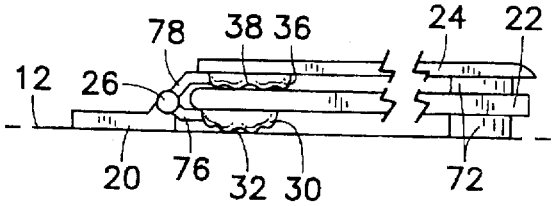
FIG. 5 is a side elevational view, similar to FIG. 4, but showing the toilet seat cover and the toilet seat in the lower position.

The second lever 58 has an outer end 68. Movement of the flush lever 18 to the lower position will result in the link 56 being extended causing the second lever 58 to be pivoted in a single plane in the direction of arrow 70 which is shown in FIG. 2 of the drawings. This will result in the outer end 68 coming in contact with the toilet seat cover 24 which will result in the toilet seat cover 24 being moved from the upper vertical stable position as shown in FIG. 1 to the lower horizontal position shown in FIG. 5. If per chance the toilet seat 22 is also in its upper vertical stable position, the toilet seat 22 will likewise be moved to the lower position as shown in FIG. 5. It is to be noted that automatically upon moving of the flush lever 18, the toilet seat cover 24 and the toilet seat 22 will automatically be moved to the lower position. It is also to be noted that the underside of both the toilet seat 22 and the toilet seat cover 24 include conventional solid, resilient cushioning pads 72 that are to cushion the toilet seat 22 relative to the toilet bowl 12 and also cushion the toilet seat cover 24 relative to the toilet seat 22.

When the flush lever 18 is released, it is desirable to have the second lever 58 automatically moved from its outwardly extended position shown in dotted lines in FIG. 2 to a retracted position shown in the solid line position shown in FIG. 2. In order to achieve this, there is mounted a coil spring 74 between the horizontal shelf 62 and the second lever 58. This coil spring 74 will exert a continuous bias on the second lever 58 tending to locate such in its retracted position which is the solid line position shown in FIG. 2. Upon the flush lever 18 being released, the coil spring 74 will automatically move the second lever 58 back to the solid line position shown in FIG. 2 with the first lever 48 being moved to the solid line position shown in FIG. 3.

What is claimed is:

1. A lowering apparatus for a toilet seat and toilet seat cover, said toilet seat and said toilet seat cover being hingedly mounted on a toilet bowl having a water tank mounted thereon wherein said water tank has a pivotally mounted flush lever mounted thereon, said water tank having an exterior sidewall, said toilet seat and said toilet seat cover being pivotally movable between an upper position and a lower position, said upper position locating said toilet seat cover directly adjacent said exterior sidewall of said water tank and locating said toilet seat directly adjacent said toilet seat cover, said lower position locating said toilet seat on said toilet bowl and said toilet seat cover on said toilet seat, said pivotally mounted flush lever mounted on said exterior sidewall of said water tank, said flush lever to be movable from an at rest position to an actuated position to empty water from said water tank, said lowering apparatus comprising:

an elongated main body section adapted to be secured on said exterior sidewall of said water tank, said elongated main body section having an aft end and a fore end;

a first lever movably mounted on said elongated main body section, said first lever located at said aft end, said first lever being located directly adjacent said flush lever;

a second lever movably mounted within a single plane on said elongated main body section, said second lever located at said fore end, said second lever being positioned to contact said toilet seat cover when said toilet seat cover is located in said upper position, said second lever being pivotally mounted to said elongated main body section about a pivot axis, said pivot axis being located parallel to said exterior sidewall of said water tank, said pivot axis being vertically oriented; and a thin rod link pivotally connected to said first lever connecting said first lever and said second lever, whereby movement of said flush lever to said actuated position causes said first lever to be moved which moves said link which moves said second lever against said toilet seat cover causing said toilet seat cover and said toilet seat, if located in said upper position, to move to said lower position.

2. The lowering apparatus as defined in claim 1 including:

a spring means connected between said elongated main body section and said second lever, said spring means exerting a continuous bias against said second lever tending to locate said second lever in a retracted position which is a non-actuated position, said retracted position permitting said toilet seat cover and said toilet seat to be located in said upper position.

* * * * *